US005655301A

United States Patent [19]

Dickson

[11] Patent Number: 5,655,301

[45] Date of Patent: Aug. 12, 1997

[54] ROTARY HAIR TRIMMER AND METHOD FOR MAKING THE SAME

[75] Inventor: Kevin Dickson, Highlands Ranch, Colo.

[73] Assignee: PHR Systems, Inc., Westcliffe, Colo.

[21] Appl. No.: 545,935

[22] Filed: Oct. 20, 1995

[51] Int. Cl.[6] ..... B26B 19/16

[52] U.S. Cl. ..... 30/29.5; 29/428

[58] Field of Search ..... 30/29.5, 265, 347, 30/43.6; 76/104.1; 29/428

[56] References Cited

U.S. PATENT DOCUMENTS 2,801,465 8/1957 Cason ..... 30/29.5

*Primary Examiner*—Douglas D. Watts

*Attorney, Agent, or Firm*—Marger, Johnson, McCollom & Stolowitz

[57] ABSTRACT

A nose hair trimmer and method for making the same. A generally cylindrical outer handle has an axial bore therethrough. A generally cylindrical inner handle is received in the axial bore and includes an enlarged portion which abuts against one end of the outer handle and prevents the inner handle from passing further into the bore. A generally tubular outer blade is received substantially within the axial bore at the other end of the outer handle. A generally tubular inner blade is received substantially within the outer blade and is mounted on one end of the inner handle via welding. An annular lip formed on the radially inner surface of the axial bore adjacent the lower end of the inner blade is oriented to substantially prevent axial movement of the inner blade beyond the lip.

A method for making the nose hair trimmer is also provided.

25 Claims, 4 Drawing Sheets

ROTARY HAIR TRIMMER AND METHOD FOR MAKING THE SAME

BACKGROUND OF THE INVENTION

1. Field of the Invention

The present invention relates generally to hair trimmers and more particularly to such trimmers which cut hair in the vicinity of the nostrils and ears with a rotating blade.

2. Description of the Related Art

Indicated generally at 10 in FIGS. 1–4 is a prior art trimmer for cutting nose and ear hairs. The main structural components include a generally cylindrical outer handle 12 and a generally cylindrical inner handle 14. A generally tubular outer blade 16 is received in one end of an axial bore 18 formed in outer handle 12. Received in outer blade 16 is a generally tubular inner blade 20. Cap 22 covers an upper end of outer handle 12. Gripping surfaces 24, 26 are formed on outer handle 12 and inner handle 14, respectively.

Before describing in more detail the structure of prior art trimmer 10 consideration will first be given to the general manner in which the trimmer is used. A user removes cap 22 (which protects blades 20, 16) from the upper end of outer handle 12. The user then grips surface 24 between the thumb and forefinger of one hand and grips surface 26 between the thumb and forefinger of the other hand. For trimming nose hairs, the upper end of outer handle 12 is inserted approximately ⅛ inch into one of the user's nostrils. Outer handle 12 is held in place while inner handle 14 is rotated back and forth by the user. Such rotation turns inner blade 20 relative to outer blade 16 thereby cutting hairs in a known manner.

Considering now in more detail the structure of prior art trimmer 10, inner blade includes six upright teeth, like teeth 28, 30 in FIG. 3, which are equally spaced about the circumference of inner blade 20. Each tooth has a cutting edge on either side thereof, one of which is cutting edge 32 on tooth 28. The lower end of inner blade 20 includes a generally square opening 34 defined by edges 36, 38, 40, 42 in FIG. 4.

Outer blade 16 includes three upright teeth, two of which are teeth 44, 46, which are equally spaced about the circumference of the outer blade. The third tooth is obscured behind tooth 46 in the view of FIG. 2. Outer blade 16 has a lower end 48, in FIG. 3, which is abutted against an annular lip 50 formed on the radially inner surface of bore 18. Blade 16 is sized to be press fit into bore 18 where it is firmly held in place.

The upper end of outer handle 12 includes six upright prongs, like prongs 51, 53, 55, 57, which are equally spaced about the perimeter of outer handle 12. Bore 18 includes a cylindrical portion 52 which extends downwardly from annular lip 50 and connects to a slightly tapered portion 54. Tapered portion 54 connects to an even more tapered portion 56 of bore 18 which in turn connects with another cylindrical portion 58. An annular groove 60 is formed on the radially inner surface of cylindrical portion 58.

Considering now inner handle 14, an upper cylindrical portion 62 includes an axial cylindrical bore 64 (in FIG. 3) therethrough. A generally square nipple 66 extends upwardly from the top of upper cylindrical portion 62. As can be seen in FIGS. 3 and 4, edges 36–42 fit around nipple 66 and substantially abut against the sides of the nipple. This resists relative rotational movement between inner blade 20 and inner handle 14. A lower cylindrical portion 66 on inner handle 14 includes a ridge 68 formed on a radially outer surface thereof.

A generally cylindrical metal insert 69 is press fit into a lower end of inner handle 14 and includes a cylindrical lower end 71 which abuts against the lowermost surface of inner handle 14. Metal insert 69 adds weight to the trimmer and thereby improves a user's ability to control the trimmer during a cutting operation.

Finishing now the description of the structure of prior art trimmer 10, a tapered pin 70 includes a head 72 having substantially planar undersurface 74. A shaft 76 includes a generally cylindrical portion which extends downwardly from surface 72 and then a tapered portion, best viewable in FIG. 3, which extends to the lower end of the pin.

Consideration will now be given to the manufacture and assembly of the components of prior art trimmer 10. Outer handle 12 and inner handle 14 are molded from polypropylene in a known manner. Blades 16, 20 are made from nickel alloy, also in a known manner. In assembling the components of the trimmer illustrated in FIG. 2, outer blade 16 is first inserted into outer handle 12 until end 48 is firmly abutted against annular lip 50. Next, inner blade 20 is pinned to inner handle 14 independently of the outer handle and outer blade combination. This is accomplished by first manually inserting pin 70 part way into bore 64. The opening defined by edges 36–42 in inner blade 20 (FIG. 4) is then manually guided over head 72 of the pin and edges 36–42 are positioned adjacent nipple 66 as shown in FIGS. 3 and 4.

Thereafter, the arbor press is used to seat pin 70 into bore 64 as shown in FIG. 3. Pin 70, nipple 66, bore 64 and inner blade 20 are sized so that surface 74 adjacent the perimeter of head 72 firmly abuts the lower end of blade 20. When in this position, the pin is securely press fit into bore 64 and undersurface 74 compresses inner blade 20 against the upper surface of upper cylindrical portion 62.

Inner handle 14, with inner blade 20 mounted thereon as described above, is next manually inserted into outer handle 12 until the upper portion of inner blade 20 is received within the lower portion of outer blade 16. Due to the close clearance between inner blade 20 and outer blade 16, rotation of inner handle 14 relative to outer handle 12 is sometimes required to permit the upper portion of inner blade 20 to be received within the lower portion of outer blade 16. The arbor press is then used to complete the press fit of inner handle 14 into outer handle 12 until ridge 68 pops into groove 60. When the ridge is received in the groove, the trimmer is configured as depicted in FIGS. 1, 3, and 4. Groove 60 and ridge 68 permit relative rotational movement of the handles (and therefore of the inner and outer blades) while resisting relative axial movement of the handles.

The foregoing structure and assembly process is disadvantageous for several reasons. First, when the inner handle is press fit into the outer handle as described above, outer blade 16 is sometimes shoved out of its seat on annular lip 50. Also, teeth on inner blade 20, like teeth 28, 30, are sometimes bent thereby impairing cutting action of the trimmer. Although it is possible to press fit inner handle 14 into outer handle 12 prior to mounting inner blade 20 with pin 70, it would be very difficult if not impossible to thereafter align edges 36–42 of the inner blade with the square sides of nipple The foregoing assembly process is also disadvantageous because of the numerous press fit operations which are labor intensive.

SUMMARY OF THE INVENTION

The present invention comprises a hair trimmer having a generally cylindrical outer handle with an axial bore therethrough. A generally tubular outer blade has a generally tubular inner blade received therein. The outer blade, the inner blade and a generally cylindrical inner handle are received in the axial bore in the outer handle. In one aspect, an annular lip, formed on the radially inner surface of the axial bore adjacent one end of the inner blade is oriented to substantially prevent axial movement of the inner blade beyond the lip. In another aspect, a weld formed between the inner blade and the handle secures the inner blade to one end of the handle. In still another aspect, an enlarged portion formed on one end of the inner handle abuts a lower end of the outer handle.

A method for making such a hair trimmer is also provided in which the outer blade is inserted into the axial bore and positioned adjacent a first end of the bore. The inner handle is inserted into a second end of the bore. The inner blade is inserted into the outer blade and thereafter mounted on the inner handle.

The foregoing and other objects, features and advantages of the invention will become more readily apparent from the following detailed description of a preferred embodiment Which proceeds with reference to the drawings.

DETAILED DESCRIPTION OF THE PREFERRED EMBODIMENT

Figure 1:
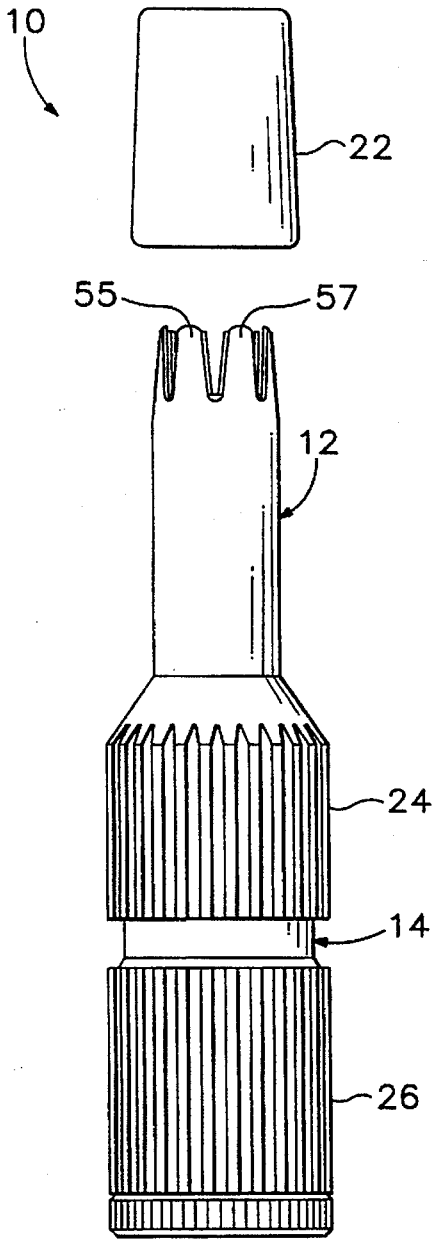
FIG.1 (PRIOR ART)
FIG. 1 is an elevational view of a prior art trimmer and cap.
Figure 2:
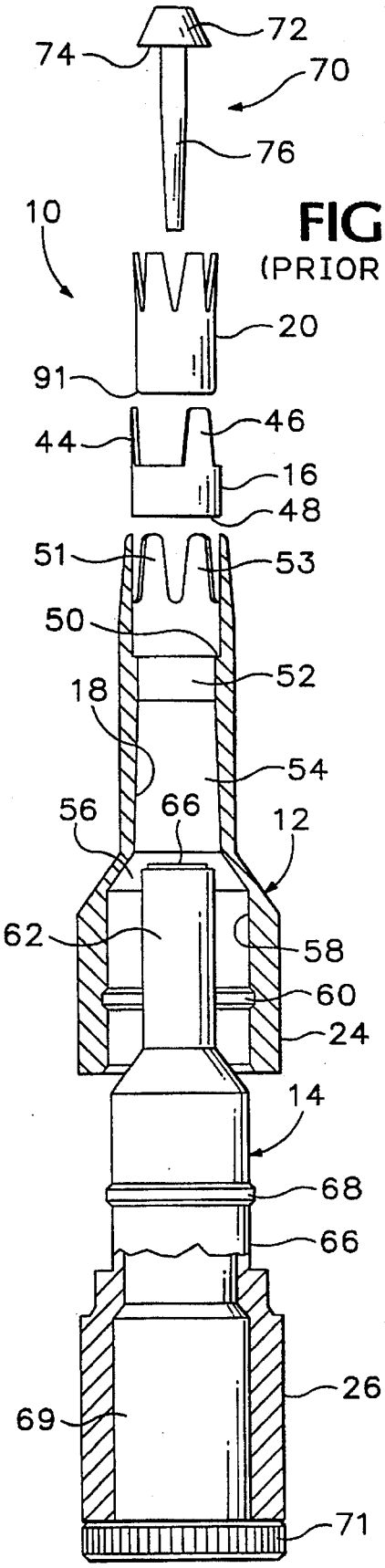
FIG.2 (PRIOR ART)
FIG. 2 is an exploded partially sectional view of the trimmer of FIG. 1.
Figure 3:
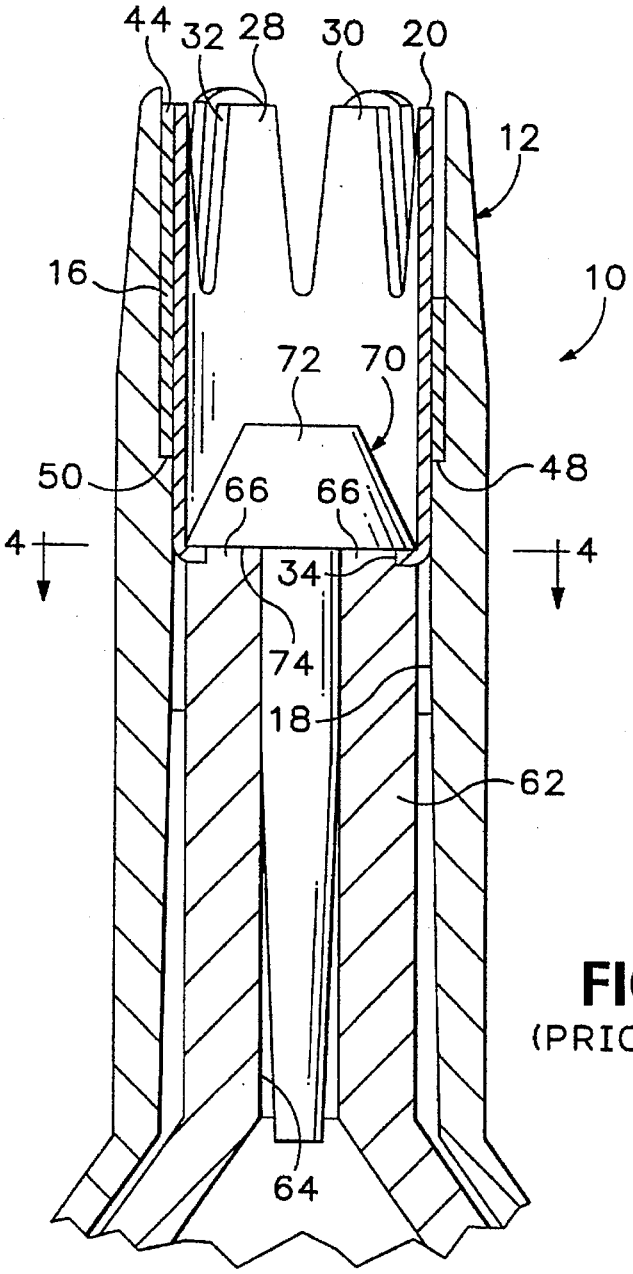
FIG.3 (PRIOR ART)
FIG. 3 is an enlarged sectional view of a portion of the prior art trimmer of FIG. 1.
Figure 4:
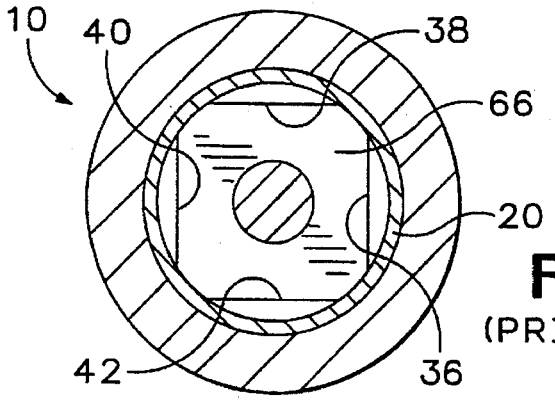
FIG.4 (PRIOR ART)
FIG. 4 is a view taken along line 4—4 in FIG. 3.
Figure 5:
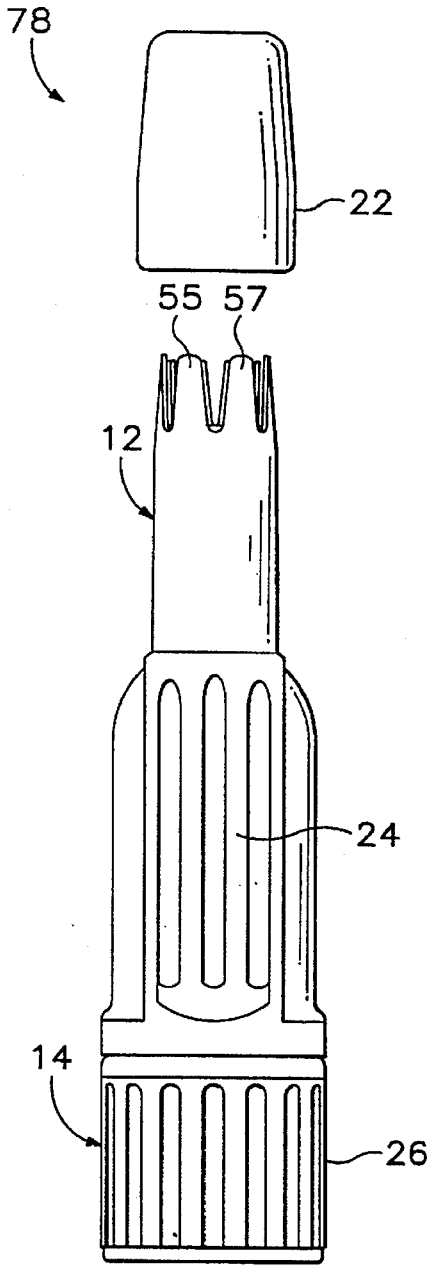
FIG. 5 is an elevational view of a preferred embodiment of a trimmer constructed in accordance with the present invention.
Figure 6:
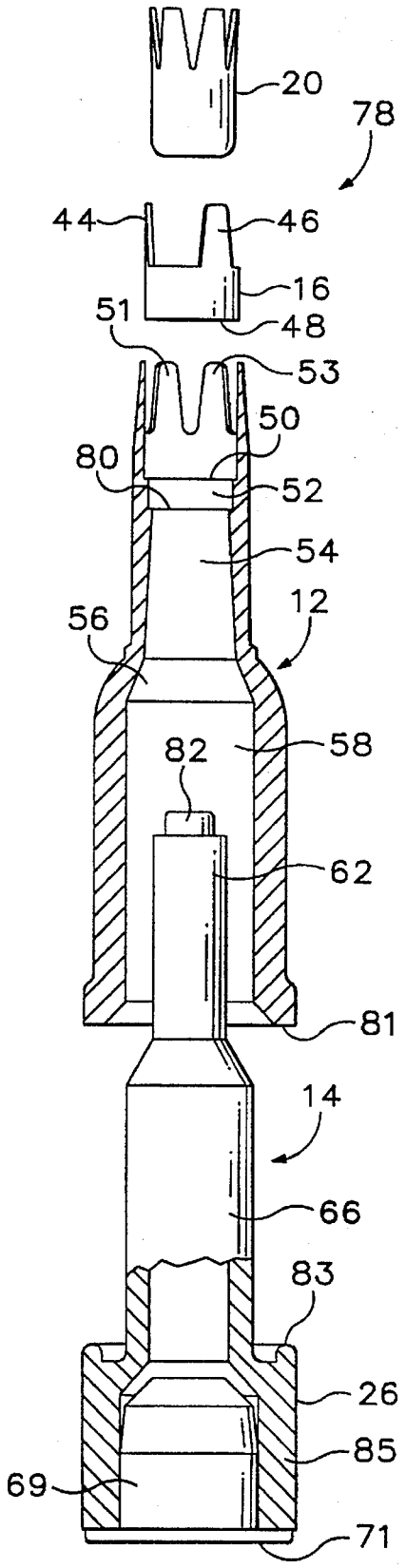
FIG. 6 is an exploded partially sectional view of the trimmer of FIG. 5.

Turning now to FIGS. 5–9, consideration will now be given to the structure, operation, and assembly of a preferred trimmer, indicated generally at 78, constructed in accordance with the present invention. Numerals identifying structure in prior art trimmer 10 appear again in FIGS. 5–9 to identify similar structure in trimmer 78.

Consideration will now be given to new and different structure in trimmer 78 which is not included in prior art trimmer 10. Directing attention to FIG. 6, immediately beneath annular lip 50 is another annular lip 80 which, like annular lip 50, extends about the radially inner circumference of outer handle 12. A lower end 81 of outer handle 12 comprises an annular substantially planar surface.

Figure 7:
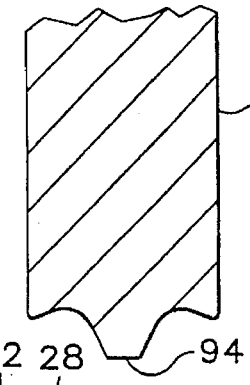
FIG. 7 is an enlarged sectional view of a portion of the trimmer of FIG. 5 prior to welding and with a sonic welding horn tip positioned above the trimmer.
Figure 8:
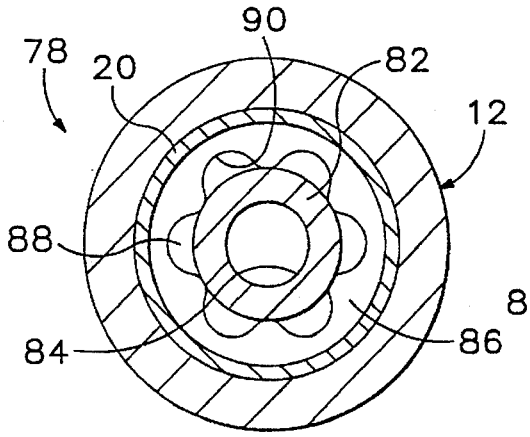
FIG. 8 is a view taken along line 8—8 in FIG. 7.

Upper cylindrical portion 62 of inner handle 14 includes at the upper end thereof an upright cylindrical nipple 82, best viewed in FIGS. 7 and 8. Nipple 82 includes an axial bore 84 extending downwardly from the upper surface of the nipple. An upwardly directed annular ridge 83 is formed on an enlarged portion 85 opposite end 81 on inner handle 14.

Both inner handle 14 and outer handle 12 are molded from acetal in a known manner.

Considering now inner blade 20, as in prior art trimmer 10, the upper end thereof is open. In trimmer 78, however, there is a partially closed lower end 86 having a central opening 88 defined by an edge 90 which forms a generally sinusoidal shape about the circumference of opening 88. Blade 20 has a curved lower outer surface 91.

As will shortly be explained, a commercially available sonic welder (not shown) includes a specially designed horn tip 92 on a lower end thereof. The horn tip includes a post 94 having a curved surface thereabout as shown in FIG. 7. The sonic welder vibrates horn tip 92 at the rate of 20,000 cycles per second and includes a mechanism for raising and lowering the horn tip to different elevations such as those shown in FIGS. 7 and 9.

In assembling trimmer 78, outer blade 16 is first press fit into outer handle 12 until end 48 of the blade seats against annular lip 50 as shown in FIG. 7. The relative sizes of blade 16 and the bore in inner handle 12 in which it is received are such that when the blade is as shown in FIG. 7, it is firmly held in position and does not move relative to outer handle 12. Preferably, in the next operation inner blade 20 is pushed into outer blade 16 and urged downwardly until lower outer surface 91 of the blade abuts against annular lip 80.

Inner handle 14 is then positioned directly beneath horn tip 92 and outer handle 12, with outer blade 16 and inner blade 20 mounted thereon, as described above, is fitted over the top of the inner handle. The outer handle lowers until end 81 (in FIG. 6) rests on ridge 83 of inner handle 14 and central opening 88 is received around nipple 82 as shown in FIG. 7. When so configured, the upper end of the trimmer appears as in FIG. 7.

Inner blade 20 need not assume any particular radial orientation relative to either outer blade 16 or nipple 82 in order to be received over the nipple. As can be seen in FIG. 7, the bottommost surface of blade 20 abuts against the upper surface of inner handle 14 about the circumference of post 82. Likewise, lower outer surface 91 of inner blade 20 abuts against annular lip 80. The height of inner blade 20, the length of inner handle 14, and the location of annular lip 80 permit trimmer 78 to be assembled as described above to assume the configuration of FIG. 7. It should be appreciated that the step of inserting inner blade 20 into outer blade 16 could be performed after the step of lowering outer handle 12 over inner handle 14 without departing from the spirit of the invention. When so doing, inner blade 20 is pushed into outer blade 16, thereby receiving nipple 82 through central opening 88, until lower outer surface 91 abuts against annular lip 80.

Figure 9:
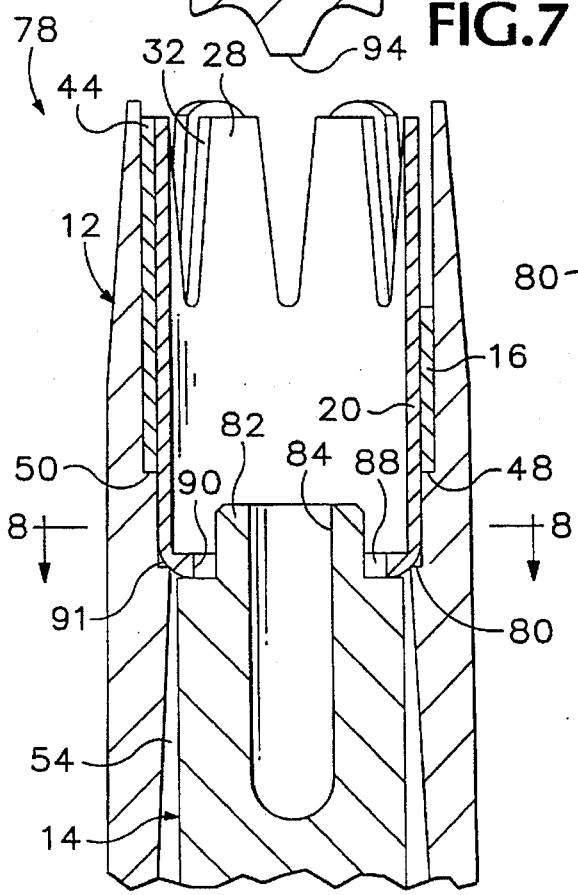
FIG. 9 is a view similar to FIG. 7 with the sonic welding horn tip shown just after welding.
Figure 9:
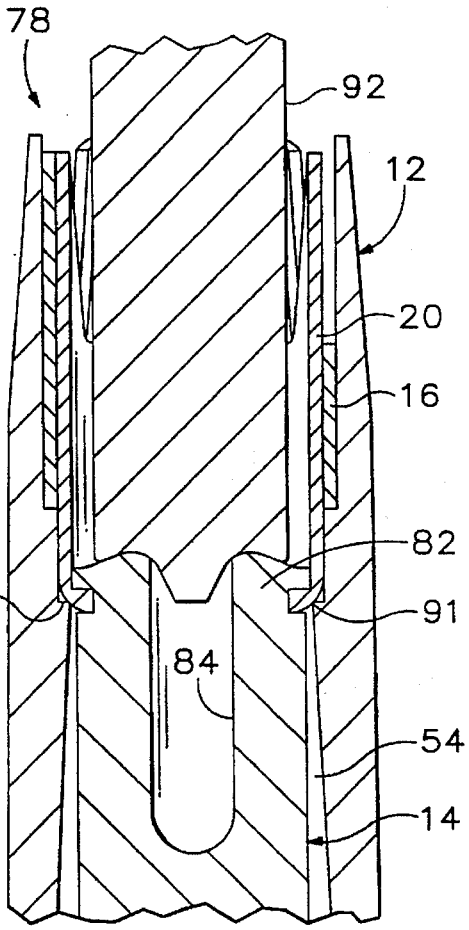
Figure 10:
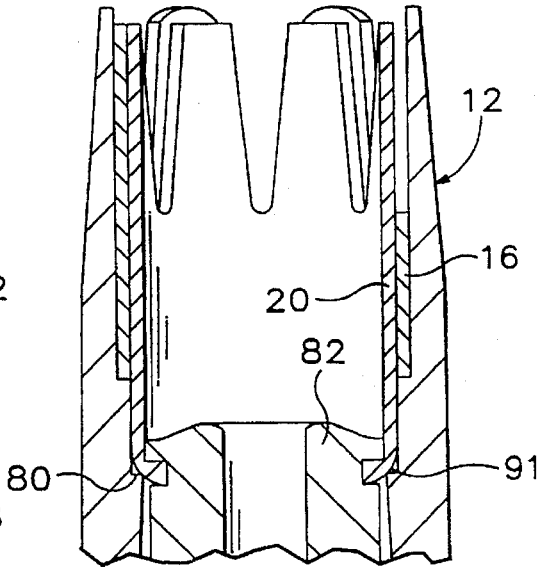
FIG. 10 is a view similar to FIG. 9 after the welding operation and removal of the sonic welding horn tip.

Components of the trimmer are now in the configuration of FIG. 7 and are ready to have horn tip 92 applied for a sonic welding operation. The sonic welder (not shown) lowers tip 92 until post 94 is received within bore 84 and the curved surfaces surrounding the post abut against the radially inner surface of bore 84 at the upper end thereof. Post 94 is guided into coaxial alignment with inner handle 14 by the curved surface about post 94 which "steers" the post into the center of bore 84. Air pressure of 18 lbs. per square inch is applied to horn tip 92 in a known manner to urge it downwardly against post 82 during a weld time of 1 second, at 20,000 cycles per second vibration, and after holding for a period of ¾ second during which no vibration occurs while the melted acetal cools and hardens. As is known in the art of sonic welding, the vibrations heat the material being welded, typically a polymeric material, to its melting point to create a weld. During the welding operation, the upper portion of nipple 82 melts and flows into central opening 88 in inner blade 20 between the radially outer surface of post 82 and edge 90 of the central opening thereby filling the opening as shown in FIG. 9. Further melting of the upper portion of the nipple causes acetal to flow outwardly to the radially inner surface of inner blade 20 as shown in FIG. 9. The view of FIG. 9 illustrates the configuration of the trimmer after sonic welding is complete and during the short period thereafter while tip 92 is held against the nipple while the melted acetal cools. Thereafter tip 92 is withdrawn leaving nipple 82 in the configuration shown in FIG. 10.

The configuration of central opening 88 after the welding process provides a weld which resists relative torque between the inner handle and the inner blade better than, e.g., a circular central opening. At the same time, central opening 88 permits inner blade 20 to be inserted over nipple 82 without any particular radial orientation relative to the nipple, unlike the prior art square opening. This permits trimmer 78 to be assembled and welded as described above.

After welding, it can be seen that the weld joins inner handle 14 and inner blade 20 together as shown in FIG. 9. The action of annular shoulder 80 against the lower outer surface of inner blade 20 prevents the inner handle-inner blade combination from being withdrawn from the lower end of outer handle 12. Similarly, because end 81 abuts against ridge 83 (in FIG. 6), inner handle 14 and inner blade 20 cannot be urged upwardly any further relative to outer handle 12 than the configuration depicted in FIG. 9. It can also be seen that in the assembled configuration, inner handle 14 and outer handle 12 (and thus the inner and outer blades) are freely rotatable relative to one another.

It can thus be seen that the assembly method of the present invention substantially reduces the number of assembly operations in the prior art method describe above. As noted above, the assembly method of the invention is not only less labor intensive, it provides a more durable trimmer and one which is less likely to be damaged during the assembly process.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A hair trimmer comprising:

a generally cylindrical outer handle having an axial bore therethrough;

a generally cylindrical inner handle received in said axial bore;

a generally tubular outer blade received substantially within said axial bore;

a generally tubular inner blade received substantially within said outer blade having a first open end and a second partially closed end, said second end having a central opening formed therethrough;

an upright nipple extending from a first end of said inner handle, said nipple being received in said inner blade central opening and a distal end of said nipple being melted thereby mounting the inner blade on said inner handle; and an annular lip formed on a radially inner surface of said axial bore, said lip being adjacent one end of said inner blade and being oriented to substantially prevent axial movement of said inner blade beyond said lip.

2. The hair trimmer of claim 1 wherein said inner handle further includes a second end, having an enlarged portion which abuts against an end of said outer handle.

3. The hair trimmer of claim 1 wherein said inner blade is metal, said inner handle is a polymeric material.

4. The hair trimmer of claim 1 wherein said central opening is defined by an edge having a generally sinusoidal shape.

5. A hair trimmer comprising:

a generally cylindrical outer handle having an axial bore therethrough;

a generally cylindrical inner handle received in said axial bore including first and second ends;

a generally tubular outer blade received substantially within said axial bore;

a generally tubular inner blade received substantially within said outer blade, said inner blade being mounted on the first end of said inner handle;

a weld formed between said inner blade and said handle to secure said inner blade to the first end of said handle; and an enlarged portion formed on the second end of said inner handle abutting a lower end of said outer handle.

6. The hair trimmer of claim 5 wherein said inner handle is a polymeric material and wherein said weld is a sonic weld.

7. The hair trimmer of claim 5 wherein said hair trimmer further includes an annular lip formed on the radially inner surface of said axial bore, said lip being adjacent one end of said inner blade and being oriented to substantially prevent axial movement of said inner blade beyond said lip.

8. The hair trimmer of claim 5 wherein said inner blade includes a first open end and a second partially closed end, said second end having a central opening formed therethrough.

9. The hair trimmer of claim 8 wherein said inner handle includes an upright nipple extending from said first end, said nipple being received in said central opening and the distal end of said nipple being melted to mount the inner blade on said inner handle.

10. The hair trimmer of claim 8 wherein said central opening is defined by an edge having a sinusoidal shape.

11. A method for making a hair trimmer of the type comprising a generally cylindrical outer handle having an axial bore therethrough, a generally cylindrical inner handle received in said axial bore, a generally tubular outer blade received substantially within said axial bore, and a generally tubular inner blade received substantially within said outer blade and mounted on one end of said inner handle, said method comprising the steps of:

inserting the outer blade into said axial bore and positioning it adjacent a first end of said bore;

inserting the inner blade into the outer blade;

inserting the inner handle into a second end of said bore; and after inserting the inner handle into a second end of said bore mounting the inner blade on the inner handle.

12. The method of claim 11 wherein the step of mounting the inner blade on the inner handle comprises the step of melting a portion of the inner handle.

13. A method for making a hair trimmer of the type comprising a generally cylindrical outer handle having an axial bore therethrough, a generally cylindrical inner handle received in said axial bore, a generally tubular outer blade received substantially within said axial bore, and a generally tubular inner blade received substantially within said outer blade and mounted on one end of said inner handle, said method comprising the steps of;

inserting the outer blade into said axial bore and positioning it adjacent a first end of said bore;

inserting the inner handle into a second end of said bore;

after inserting the inner handle into the second end of said bore, inserting the inner blade into the outer blade; and mounting the inner blade on the inner handle.

14. The method of claim 13 wherein said inner blade includes a first open end and a second partially closed end having a central opening formed therethrough and wherein said one end of said inner handle includes a nipple extending therefrom, said method further comprising the step of fitting the nipple into the opening during the step of inserting the inner blade into the outer blade.

15. The method of claim 14 wherein said method further comprises the step of melting the nipple after the step of fitting the nipple into the opening.

16. The method of claim 15 wherein the step of melting the nipple comprises the step of applying a sonic welding horn to the nipple.

17. A hair trimmer comprising:

a generally cylindrical outer handle having an axial bore therethrough;

a generally cylindrical inner handle received in said axial bore, said inner and outer handles being rotatable relative to one another;

a generally tubular outer blade received substantially within said axial bore;

a generally tubular inner blade received substantially within said outer blade;

a weld formed between said inner blade and said handle to secure said inner blade to one end of said handle;

an enlarged portion formed on one end of said inner handle and abutting a lower end of said outer handle and wherein said enlarged portion prevents relative axial movement of said inner and outer handles in a first direction; and an annular lip formed on a radially inner surface of said axial bore, said lip being adjacent one end of said inner blade and being oriented to substantially prevent axial movement of said inner blade beyond said lip and wherein said annular lip prevents relative axial movement of said inner and outer handles in a second direction.

18. The hair trimmer of claim 2 wherein said enlarged portion prevents relative axial movement of said inner and outer handles in a first direction and wherein said annular lip prevents relative axial movement of said inner and outer handles in a second direction, said inner and outer handles being rotatable relative to one another.

19. The hair trimmer of claim 5 wherein said weld is a sonic weld.

20. The method of claim 16 wherein the step of mounting the inner blade on the inner handle comprises the step of melting a portion, of the inner handle.

21. The method of claim 11 wherein said inner blade includes a first open end and a second partially closed end having a central opening formed therethrough and wherein an end of said inner handle includes a nipple extending therefrom, said method further comprising the step of fitting the nipple into the opening.

22. The method of claim 21 wherein the step of mounting the inner blade on the inner handle comprises the step of melting the nipple.

23. The method of claim 22 wherein the step of melting the nipple comprises the step of applying a sonic welding horn to the nipple.

24. The hair trimmer of claim 17 wherein said weld is a sonic weld.

25. The hair trimmer of claim 17 wherein said inner handle is a polymeric material.

* * * * *